US012369758B2

(12) United States Patent
Luo et al.

(10) Patent No.: US 12,369,758 B2
(45) Date of Patent: Jul. 29, 2025

(54) SOAP DISPENSER

(71) Applicant: JIANGSU OPPEAL DAILY COSMETICS CORP., LTD., Yangzhou (CN)

(72) Inventors: Aijun Luo, Yangzhou (CN); Hao Chen, Yangzhou (CN); Jingjing Li, Yangzhou (CN)

(73) Assignee: JIANGSU OPPEAL DAILY COSMETICS CORP., LTD., Yangzhou (CN)

( * ) Notice: Subject to any disclaimer, the term of this patent is extended or adjusted under 35 U.S.C. 154(b) by 25 days.

(21) Appl. No.: 18/408,574

(22) Filed: Jan. 10, 2024

(65) Prior Publication Data

US 2025/0151959 A1 May 15, 2025

(30) Foreign Application Priority Data

Nov. 14, 2023 (CN) ..... 202311515690.X

(51) Int. Cl.
*A47K 5/02* (2006.01)
*A47K 5/12* (2006.01)

(52) U.S. Cl.
CPC ..... *A47K 5/02* (2013.01); *A47K 5/1205* (2013.01)

(58) Field of Classification Search
CPC ..... A47K 5/02; A47K 5/1205
USPC ..... 206/77.1
See application file for complete search history.

(56) References Cited

U.S. PATENT DOCUMENTS

| | | | | | |
|---|---|---|---|---|---|
| 3,229,858 | A * | 1/1966 | Lesh | B65D 83/166 222/402.1 |
| D620,735 | S * | 8/2010 | Schmidt | D6/545 |
| 8,272,611 | B2 * | 9/2012 | Schmidt | A47K 5/12 248/312.1 |
| 9,795,255 | B2 | 10/2017 | Rosko et al. | |
| 10,342,391 | B2 * | 7/2019 | Beckerman | B05B 11/0054 |
| 10,450,731 | B2 | 10/2019 | Mchale et al. | |
| D905,466 | S * | 12/2020 | Rossi | D6/545 |
| D906,007 | S * | 12/2020 | Rossi | D6/545 |
| 11,116,364 | B1 | 9/2021 | Davis | |
| D955,779 | S * | 6/2022 | Carvalho de Oliveira | D6/545 |
| D998,374 | S * | 9/2023 | Kriz | D6/545 |
| D1,005,129 | S * | 11/2023 | Runius | D9/752 |
| D1,005,130 | S * | 11/2023 | Runius | D9/752 |
| D1,006,484 | S * | 12/2023 | Schmidt | D6/545 |

(Continued)

*Primary Examiner* — Ernesto A Grano
(74) *Attorney, Agent, or Firm* — True Shepherd LLC; Andrew C. Cheng

(57) ABSTRACT

A soap dispenser includes a fixing bracket, a locking mechanism, a pivot, a position-limiting bracket, a back plate, a base, a soap bottle and a magnetic unlocking device. The fixing bracket includes a first bracket, a connecting plate and a second bracket, and a locking hole is defined on the second bracket. The locking mechanism includes a lock body, a lock cap, a spring, an iron block and a lock rod. An internal hollow chamber is defined by the lock body and the lock cap, the hollow chamber is in communication with the locking hole, the spring abuts against the iron block, the lock rod is arranged on the iron block, and the lock rod is extendable to extend through the locking hole. The position-limiting bracket has a front hook portion, a locking groove is defined on the position-limiting bracket, the position-limiting bracket is connected with the second bracket.

10 Claims, 9 Drawing Sheets

(56) References Cited

U.S. PATENT DOCUMENTS

| | | | | |
|---|---|---|---|---|
| 12,016,501 | B2 * | 6/2024 | Runius | A47K 5/12 |
| 2011/0101196 | A1 * | 5/2011 | Schmidt | A47K 5/12 248/553 |
| 2016/0288151 | A1 * | 10/2016 | Schultz | F16M 13/02 |
| 2018/0153354 | A1 * | 6/2018 | Beckerman | B05B 11/0054 |
| 2020/0324936 | A1 * | 10/2020 | Fabozzi | B65D 47/00 |
| 2022/0007897 | A1 * | 1/2022 | Rossi | A47K 5/1205 |
| 2022/0225845 | A1 * | 7/2022 | Steinmetz | F16M 13/022 |
| 2023/0107438 | A1 * | 4/2023 | Marchand | B05B 15/62 222/105 |
| 2023/0346171 | A1 * | 11/2023 | Runius | F16M 13/02 |
| 2023/0397777 | A1 * | 12/2023 | Sisto | F16B 2/10 |
| 2024/0099519 | A1 * | 3/2024 | Runius | F16M 13/02 |
| 2024/0188763 | A1 * | 6/2024 | Schmidt | A47K 5/1205 |
| 2024/0398174 | A1 * | 12/2024 | Fernandez Diez | A47K 5/1205 |
| 2025/0010318 | A1 * | 1/2025 | Lowance | B05B 11/1047 |

* cited by examiner

SOAP DISPENSER

CROSS-REFERENCE TO RELATED APPLICATIONS

This application is claims priority to Chinese Patent Application No. 202311568036.5, with a filing date of Nov. 22, 2023. The content of the aforementioned application, including any intervening amendments thereto, is incorporated herein by reference.

FIELD

The present application relates to the technical field of bathroom products, and in particular to a soap dispenser.

BACKGROUND

With the continuous improvement of people's pursuit of quality of life, the demand for cleaning products is also increasing. Soap dispenser, as a common cleaning product, is widely used in families, public places and other scenes. However, the conventional soap dispenser generally has certain safety hazards and problems, such as being vulnerable to theft and inconvenient to replace. Therefore, how to improve the safety, convenience, and durability of the soap dispenser has become an urgent problem to be solved.

SUMMARY

A soap dispenser is provided according to the present application, so as to solve the above problems in the prior art.

In order to achieve the above object, the following technical solutions are provided according to the present application.

According to an aspect of the present application, a soap dispenser includes a fixing bracket, a locking mechanism, a pivot, a position-limiting bracket, a back plate, a base, a soap bottle and a magnetic unlocking device;

the fixing bracket includes a first bracket, a connecting plate and a second bracket, the first bracket is connected with the second bracket by the connecting plate, and a locking hole is defined on the second bracket;

the locking mechanism includes a lock body, a lock cap, a spring, an iron block and a lock rod; an internal hollow chamber is defined by the lock body and the lock cap, the hollow chamber is in communication with the locking hole; one end of the spring abuts against the top of the hollow chamber, and the other end of the spring abuts against the iron block; the iron block is movable reciprocally in the hollow chamber, the lock rod is arranged on the iron block, and the lock rod is extendable to extend through the locking hole;

the position-limiting bracket has a front hook portion, a locking groove is defined on the position-limiting bracket, the position-limiting bracket is connected with the second bracket by the pivot, and the bottom of the lock rod is extendable into the locking groove;

one end of the back plate is connected with the second bracket, the other end of the back plate is connected with the base, and the base is configured to bear the soap bottle; and a magnetic block is provided on the magnetic unlocking device, the magnetic block is configured to attract the iron block to compress the spring to approach the top of the hollow chamber, so that the bottom of the lock rod is disengaged from the locking groove.

Further, a front end of the first bracket and a front end of the second bracket are arc-shaped.

Further, a pivot groove is defined on the position-limiting bracket, one end of the pivot extends through the pivot groove and is rotatably connected with the position-limiting bracket, and the other end of the pivot is rotatably connected with the second bracket.

Further, a mounting hole is defined on the back plate.

Further, multiple holding plates are provided on the base, and the multiple holding plates are arranged around the base.

Further, the holding plates include a first holding plate, a second holding plate and a third holding plate, the first holding plate is arranged on a side, away from the back plate, of the base, and an included angle between the second holding plate and the first holding plate and an included angle between the third holding plate and the first holding plate are right angles.

Further, a protrusion is provided in the middle of the base.

Further, the soap dispenser further includes a position-limiting column, where a position-limiting groove is defined on the position-limiting bracket, one end of the position-limiting column is fixedly connected with the second bracket, and the other end of the position-limiting column is inserted into the position-limiting groove.

Further, a lifting ring is provided on the magnetic unlocking device.

Further, the soap dispenser is made of pure metal material.

The present application has the following advantages.

During use, the magnetic unlocking device is attached to the top of the lock cap. At this time, the iron block drives the lock rod to retract into the hollow chamber under the magnetic attraction of the magnetic block. When the lock rod is disengaged from the locking groove, the position-limiting bracket is rotatable around the second bracket. The bottle body is placed on the base, an upper end of a pump abuts against the first bracket, and a lower end of the pump abuts against the second bracket. At this time, the position-limiting bracket is rotated, and the front hook portion of the position-limiting bracket catches a neck portion of the bottle body. When the magnetic unlocking device is detached from the top of the lock cap, the position-limiting bracket is rotated, the iron block falls back to the bottom of the hollow chamber and drives the lock rod to extend into the locking groove by relying on the gravity of the iron block and the elastic potential energy stored by the spring, thus achieving the locking effect.

1. The soap dispenser is provided according to the present application, which has an anti-theft function and is difficult to detect from appearance, thus avoiding resistance of the consumer to anti-theft equipment.

2. The replacement of the soap dispenser is more convenient by providing the locking mechanism according to the present application, which improves the work efficiency of the cleaner.

3. The locking and unlocking of the soap dispenser is more convenient and fast by using the magnetic unlocking device according to the present application, which also ensures the safety of the soap bottle.

4. The present invention is applicable to various public places, such as public toilets, hotels, shopping malls, etc., and has good market application prospects.

5. The present invention is made of pure metal material, which facilitates recycling and saves resources.

BRIEF DESCRIPTION OF THE DRAWINGS

In order to illustrate solutions of the embodiments of the present application or in the conventional technology more clearly, the drawings used in the description of the embodiments or conventional technology are briefly described below. It is apparent that the drawings in the following description are only exemplary. For those of ordinary skill in the art, other implementation drawings can be derived from the provided drawings without any creative efforts.

The structure, proportion, and size shown in the drawings of the specification are only used to match the contents disclosed in the specification for those skilled in the art to understand and read, and are not intended to limit the conditions under which the present application can be implemented, having no technically substantive significance. Any modification of structure, change of proportional relationship, or adjustment of size should still fall within the scope of the technical content disclosed in the present application without affecting the efficacy and purpose of the present application.

Figure 1:
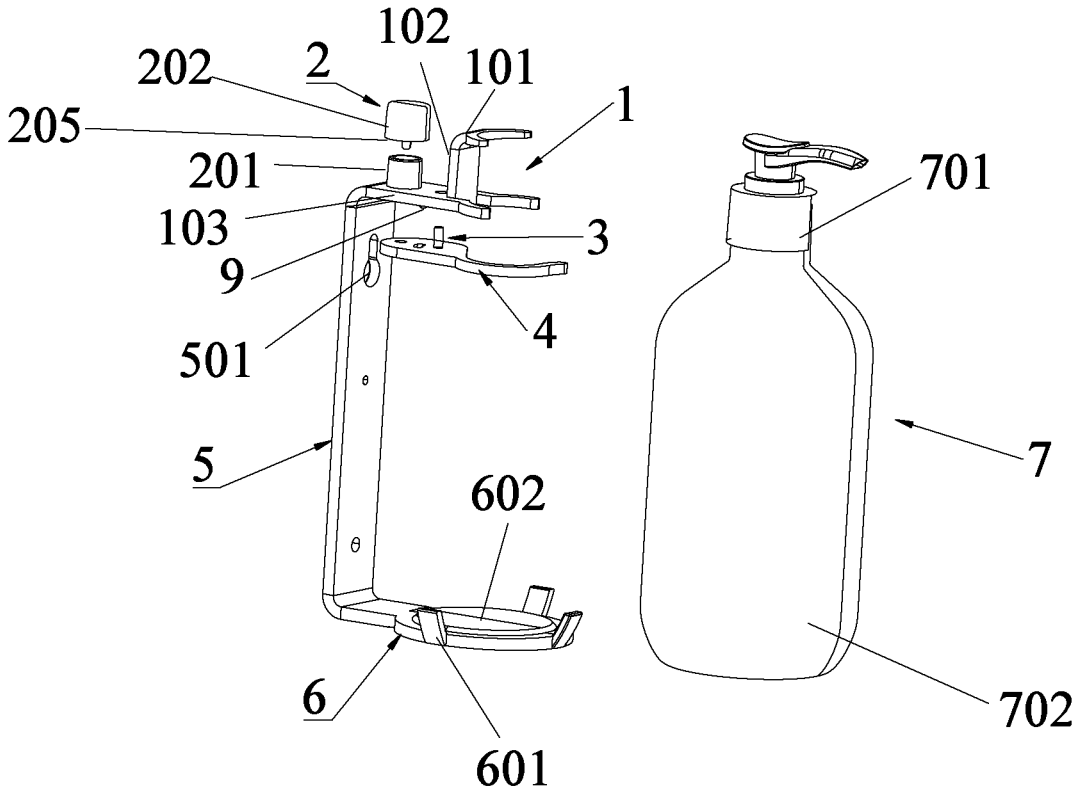
FIG. 1 is a schematic exploded view of a soap dispenser according to some embodiments of the present application viewed from a first perspective.
Figure 2:
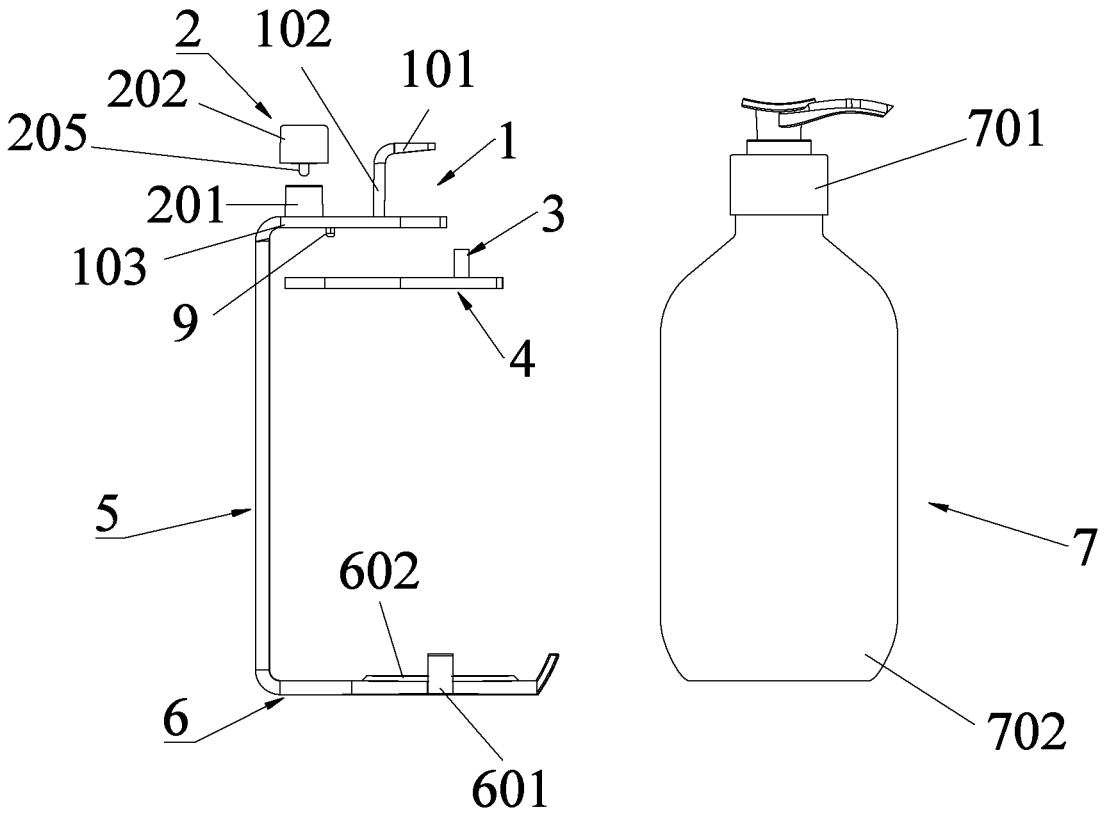
FIG. 2 is a schematic exploded view of the soap dispenser according to some embodiments of the present application viewed from a second perspective.
Figure 3:
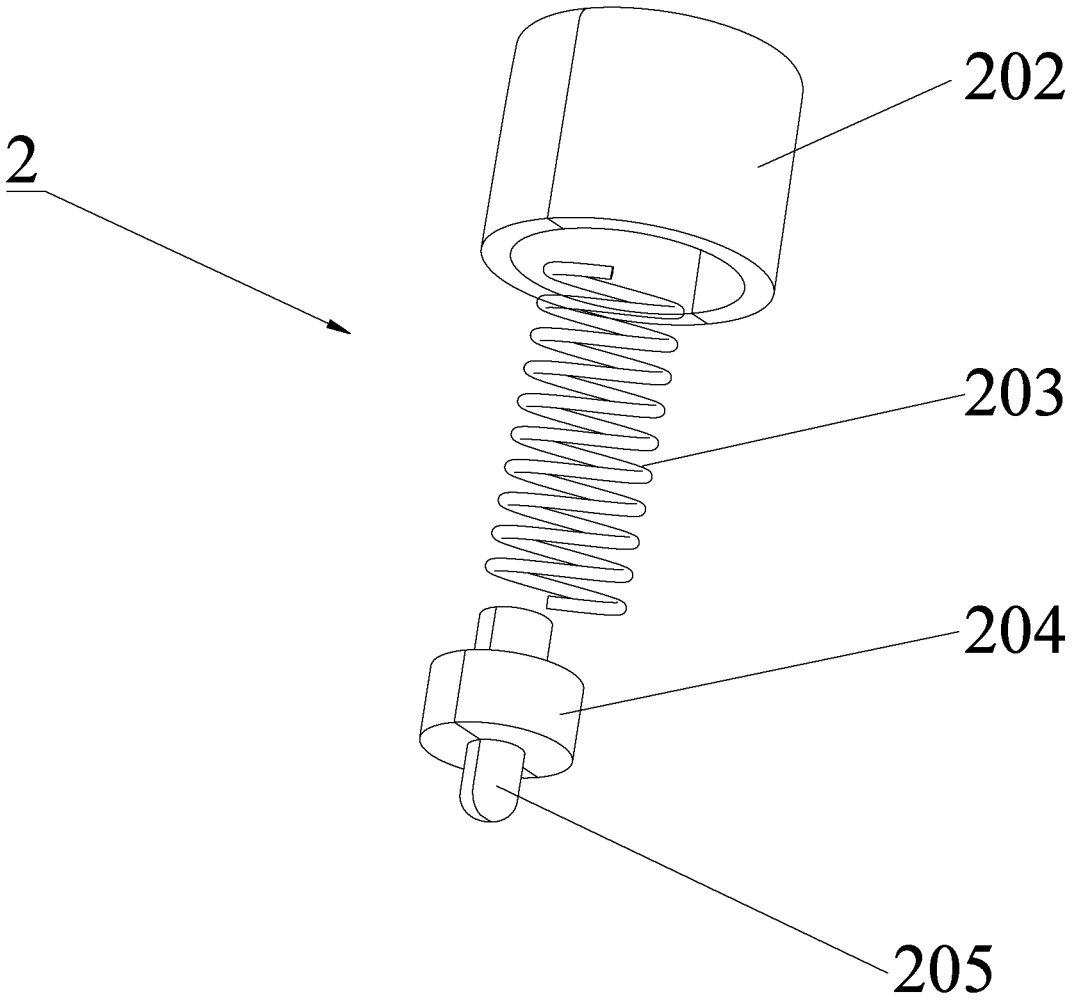
FIG. 3 is a schematic view of a locking mechanism of the soap dispenser according to some embodiments of the present application.
Figure 4:
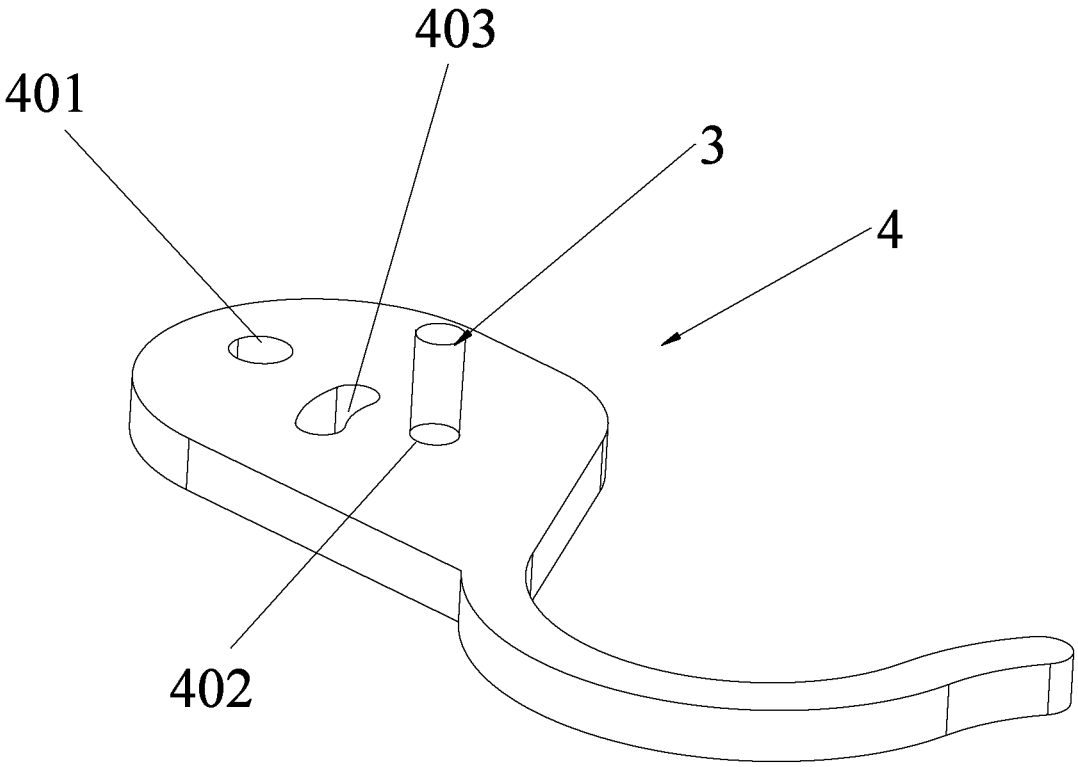
FIG. 4 is a schematic view showing a connection between a position-limiting bracket and a pivot of the soap dispenser according to some embodiments of the present application.
Figure 5:
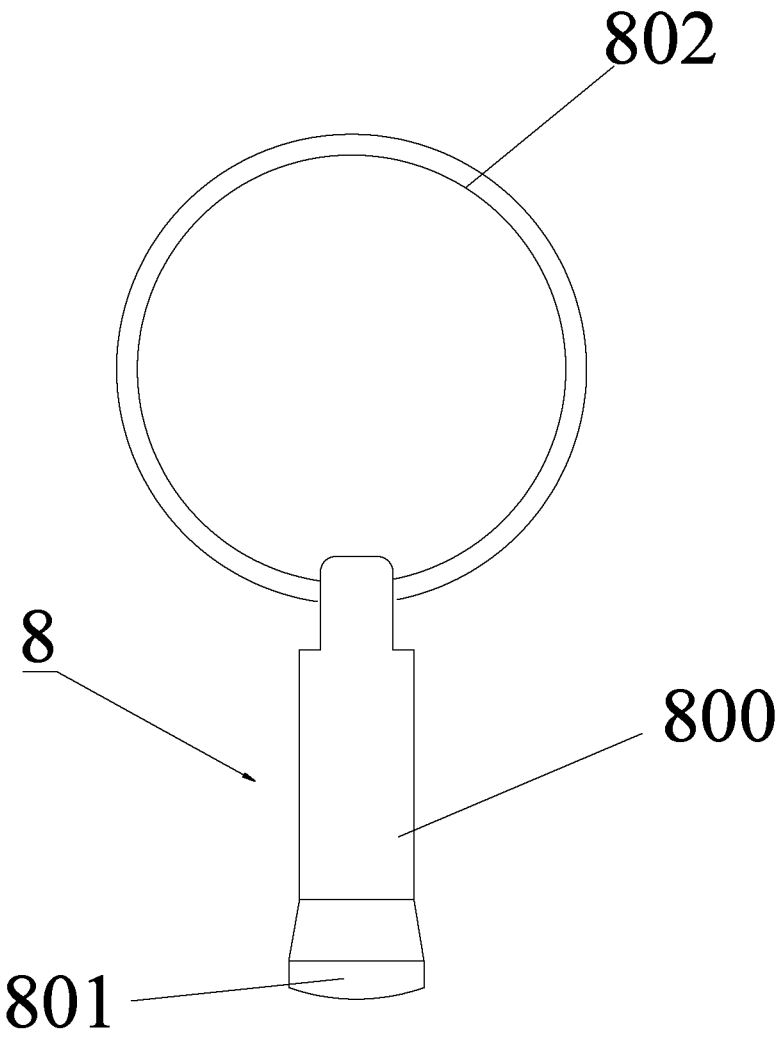
FIG. 5 is a schematic view of a magnetic unlocking device of the soap dispenser according to some embodiments of the present application.
Figure 6:
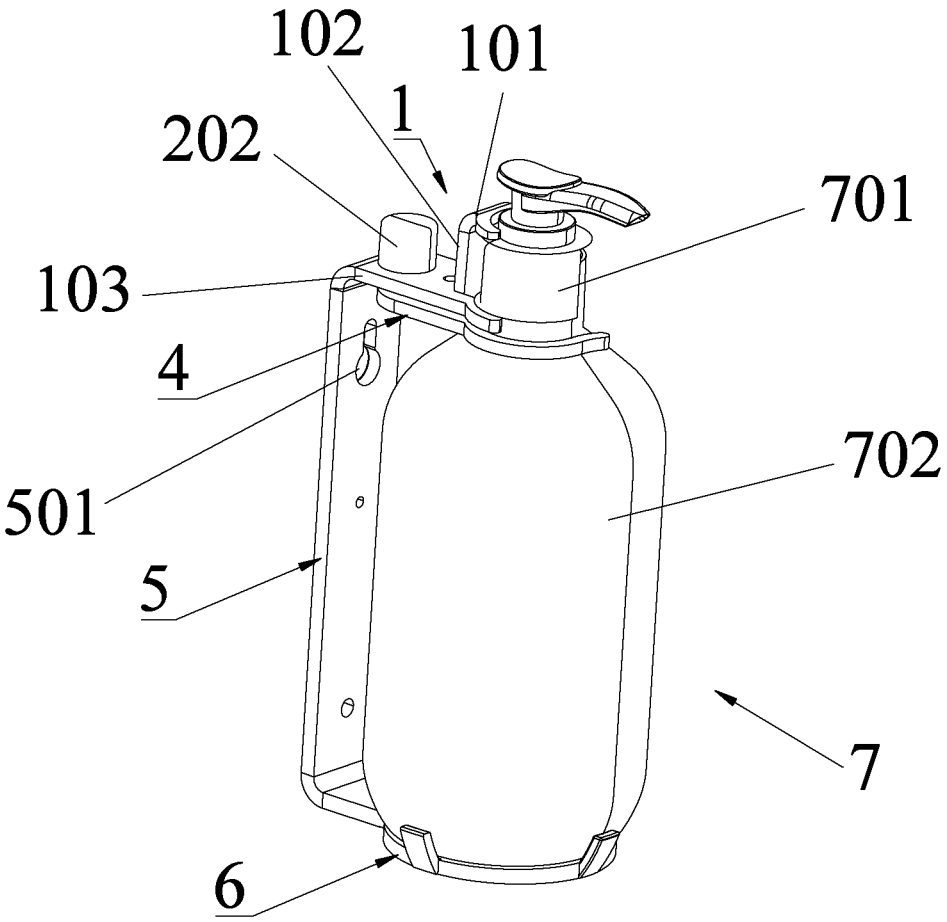
FIG. 6 is a schematic view of the soap dispenser according to some embodiments of the present application viewed from the first perspective.
Figure 7:
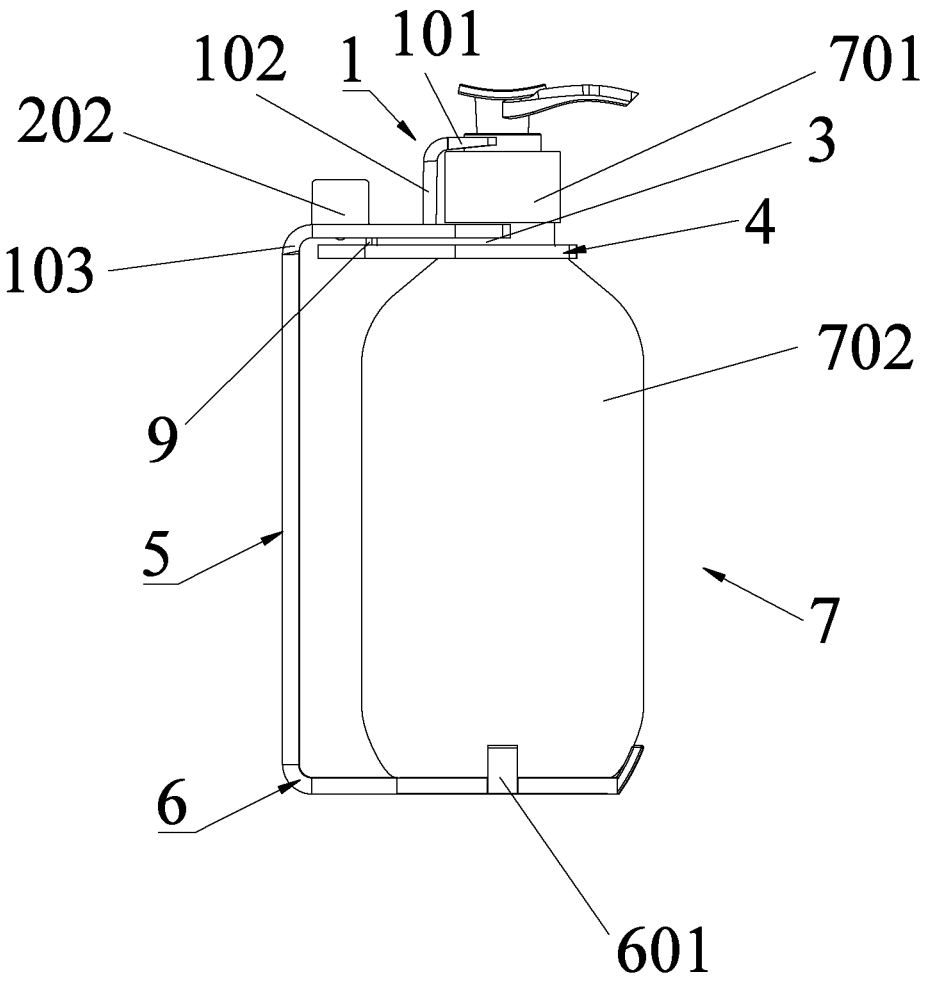
FIG. 7 is a schematic view of the soap dispenser according to some embodiments of the present application viewed from the second perspective.
Figure 8:
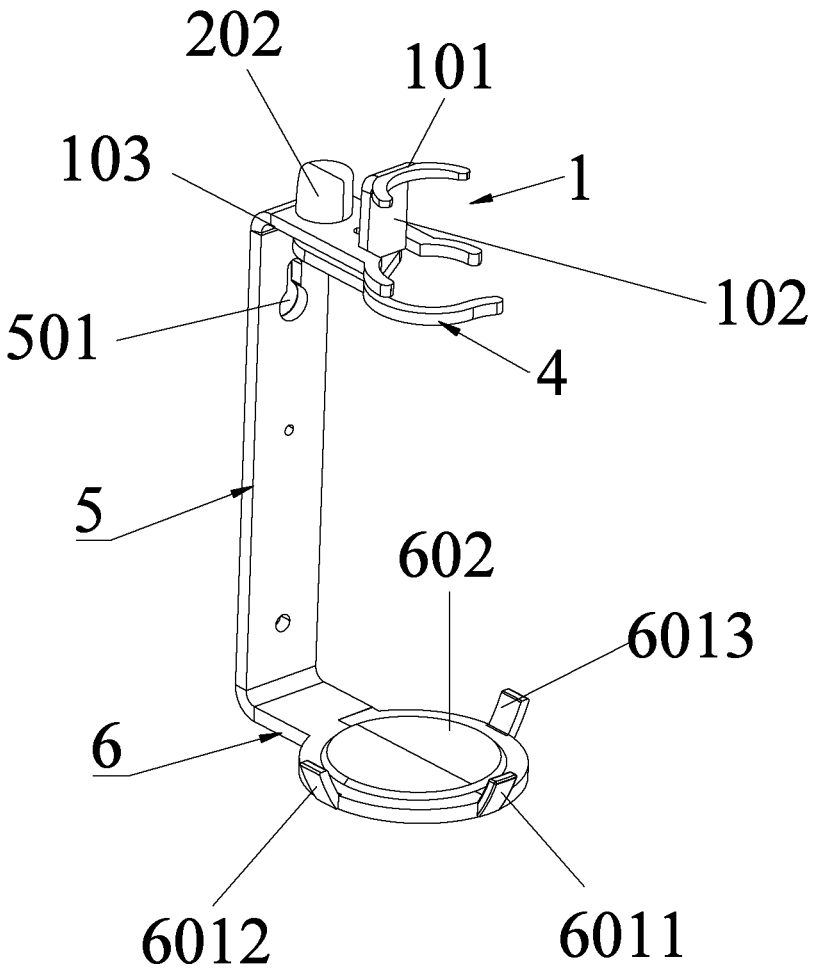
FIG. 8 is a partially schematic view of the soap dispenser according to some embodiments of the present application.

Reference numerals in the drawings are listed as follows:

1 fixing bracket, 101 first bracket, 102 connecting plate, 103 second bracket, 104 locking hole;

2 locking mechanism, 201 lock body, 202 lock cap, 203 spring, 204 iron block, 205 lock rod;

3 pivot;

4 position-limiting bracket, 401 locking groove, 402 pivot groove, 403 position-limiting groove;

5 back plate, 501 mounting hole;

6 base, 601 holding plate, 6011 first holding plate, 6012 second holding plate, 6013 third holding plate, 620 protrusion;

7 soap bottle, 701 pump, 702 bottle body;

8 magnetic unlocking device, 800 unlocking device body, 801 magnetic block, 802 lifting ring;

9 position-limiting column.

DETAILED DESCRIPTION OF THE EMBODIMENTS

The embodiments of the present application are illustrated below by specific examples. Those skilled in the art can readily understand other advantages and effects of the present application from the contents disclosed in this specification. It is apparent that the embodiments described herein are only some rather than all of the embodiments of the present application. Based on the embodiments in the present application, all of other embodiments, made by the person of ordinary skill in the art without any creative efforts, fall into the scope of protection of the present application.

First Embodiment

As shown in FIG. 1 to FIG. 9, a soap dispenser according to a first embodiment of the present application includes a fixing bracket 1, a locking mechanism 2, a pivot 3, a position-limiting bracket 4, a back plate 5, a base 6, a soap bottle 7 and a magnetic unlocking device 8.

The soap bottle 7 includes a pump 701 and a bottle body 702. The bottle body 702 is configured to store soap liquid, and the pump 701 covers the bottle body 702. The pump 701 and the bottle body 702 are in a communication state. When the pump 701 is pressed, the soap liquid inside the bottle body 702 is pumped out from an outlet of the pump 701. The bottle body 702 is generally made of a transparent material, such as glass, so that it is convenient to observe the remaining soap liquid and the usage status in the bottle body 702.

The fixing bracket 1 is configured to support the top of the soap bottle 7, for example, support a pump body of the pump 701. The fixing bracket 1 includes a first bracket 101, a connecting plate 102 and a second bracket 103. The first bracket 101 is connected with the second bracket 103 by the connecting plate 102. The first bracket 101 abuts against an upper end of the pump body of the pump 701. The connecting plate 102 is a rectangular plate or a cylindrical plate, with a height smaller than a height of the pump body of the pump 701. The second bracket 103 abuts against a lower end of the pump body of the pump 701. A locking hole 104 is defined on the second bracket 103, and the first bracket 101 and the second bracket 103 form a U-shaped structure via the connecting plate 102.

The locking mechanism 2 includes a lock body 201, a lock cap 202, a spring 203, an iron block 204 and a lock rod 205. The lock body 201 is a cylindrical hollow tube, the lock cap 202 is a cylindrical tube with a bottom opening, the lock cap 202 is sleeved outside the lock body 201, and the lock cap 202 is in interference fit with the lock body 201 to prevent the lock cap 202 from falling off from the lock body 201. An internal hollow chamber is defined by the lock body 201 and the lock cap 202. The hollow chamber is in communication with the locking hole 104. The spring 203 is located in the hollow chamber, one end of the spring 203 abuts against the top of the hollow chamber, and the other end of the spring 203 abuts against the iron block 204. The iron block 204 is movable reciprocally in the hollow chamber. The lock rod 205 is arranged on the iron block 204, and is extendable to extend through the locking hole 104. The spring 203 is a reset spring.

The position-limiting bracket 4 is located below the second bracket 103, and the position-limiting bracket 4 is movably connected with the second bracket 103 by the pivot 3. The pivot 3 may be a rotating shaft. The position-limiting bracket 4 has a front hook portion, and the front hook portion may abut against a neck portion of the bottle body 702 of the soap bottle 7. A locking groove 401 is defined on the position-limiting bracket 4, and the bottom of the lock rod 205 is extendable into the locking groove 401. The position-limiting bracket 4 and the second bracket 103 are arranged in parallel with each other. The position-limiting bracket 4 is rotatable around a horizontal direction of the second bracket 103 by the pivot 3. When the bottom of the lock rod 205 extends into the locking groove 401, the position-limiting bracket 4 cannot rotate horizontally. At this time, the soap bottle 7 is immovable and is in a locked and fixed state. When the bottom of the lock rod 205 is disengaged from the locking groove 401, the position-limiting bracket 4 is again allowed to rotate horizontally. At this time, the soap bottle 7 is movable and is in an unlocked and movable state. The front hook portion may be an arc-shaped hook or a rectangular hook. In a case that a radian value of the arc-shaped hook is greater than 180 degrees, the position-limiting bracket 4 has the best locking effect on the soap bottle 7.

One end of the back plate 5 is connected with the second bracket 103, and the other end of the back plate 5 is connected with the base 6. The base 6 is configured to bear the soap bottle 7. The back plate 5 is detachably fixed to the wall, such as by double-sided adhesive. Alternatively, a mounting hole 501 is defined on the back plate 5, to clamp the back plate 5 to the wall. Alternatively, the back plate 5 is fixed to the wall by screws or rivets. A surface, close to the wall, of the back plate 5 is a smooth plane, which can closely abut against the wall. The second bracket 103 and the base 6 are connected to form a U-shaped structure by the back plate 5. A height of the back plate 5 is substantially the same as a height of the bottle body 702.

A magnetic block 801 is provided on the magnetic unlocking device 8. The magnetic block 801 is configured to attract the iron block 204 to compress the spring 203 to approach the top of the hollow chamber, so that the bottom of the lock rod 205 is disengaged from locking groove 401.

During use, the magnetic unlocking device 8 is attached to the top of the lock cap 202. At this time, the iron block 204 drives the lock rod 205 to retract into the hollow chamber under the magnetic attraction of the magnetic block 801. When the lock rod 205 is disengaged from the locking groove 401, the position-limiting bracket 4 is rotatable around the second bracket 103. The bottle body 702 is placed on the base 6, an upper end of the pump 701 abuts against the first bracket 101, and a lower end of the pump 701 abuts against the second bracket 103. At this time, the position-limiting bracket 4 is rotated, and the front hook portion of the position-limiting bracket 4 catches a neck portion of the bottle body 702. When the magnetic unlocking device 8 is detached from the top of the lock cap 202, the position-limiting bracket 4 is rotated, the iron block 204 falls back to the bottom of the hollow chamber and drives the lock rod 205 to extend into the locking groove 401 by relying on the gravity of the iron block 204 and the elastic potential energy stored by the spring 203. If it is necessary to replace the soap bottle 7 later, the above method just needs to be performed again.

The present invention has an anti-theft function, and is difficult to detect its anti-theft function from the appearance, thus ensuring the safety of the cleaning product while avoiding unnecessary discomfort to the consumer.

By providing the locking mechanism 2, a specific magnetic unlocking device 8 needs to be used, which facilitates the replacement of the soap dispenser by the cleaner on the premise of ensuring the anti-theft function of the soap bottle 7, thereby saving working time and improving working efficiency. In addition, the present invention is simple to operate and is applicable to public spaces such as public toilets, hotels, shopping malls and other places.

Second Embodiment

As shown in FIG. 1 to FIG. 9, a soap dispenser includes all the contents of the first embodiment. In addition, a front end of the first bracket 101 and a front end of the second bracket 103 are arc-shaped, which fit the radian of the pump body of the pump 701. At this time, the clamping support effect of the first bracket 101 and the second bracket 103 on the pump body of the pump 701 is the best.

Third Embodiment

As shown in FIG. 1 to FIG. 9, a soap dispenser includes all the contents of the first embodiment and the second embodiment. In addition, a pivot groove 402 is defined on the position-limiting bracket 4, and the pivot 3 is slidable in the pivot groove 402 for a certain distance, so as to provide a larger moving space for the position-limiting bracket 4 in the unlocked state and facilitate the placement of the soap bottle 7.

Fourth Embodiment

As shown in FIG. 1 to FIG. 9, a soap dispenser includes all the contents of the first embodiment to the third embodiment. In addition, multiple holding plates 601 are provided on the base 6, and the multiple holding plates 601 are arranged around the base 6. An included angle between each holding plate 601 and the base 6 ranges from 0 degree to 180 degrees, and is preferably 145 degrees. The provision of multiple holding plates 601 can further limit the horizontal movement of the bottle body 702, thereby improving the anti-theft effect.

The number of the holding plates 601 may be three, and an included angle between any two of the three holding plates 601 is 120 degrees. The holding plates 601 include a first holding plate 6011, a second holding plate 6012 and a third holding plate 6013. The first holding plate 6011 is arranged on a side, away from the back plate 5, of the base 6, opposing the back plate 5. An included angle between the second holding plate 6012 and the first holding plate 6011 and an included angle between the third holding plate 6013 and the first holding plate 6011 are right angles. In order to further fix the bottle body 702, a protrusion 602 is provided in the middle of the base 6. The protrusion 602 fits the bottom groove of the bottle body 702, which further limits the horizontal movement of the bottle body 702, thereby improving the anti-theft effect.

Fifth Embodiment

As shown in FIG. 1 to FIG. 9, a soap dispenser includes all the contents of the first embodiment to the fourth embodiment. In addition, the soap dispenser further includes a position-limiting column 9. An arc-shaped position-limiting groove 403 is defined on the position-limiting bracket 4. One end of the position-limiting column 9 is fixedly connected with the second bracket 103, and the other end of the position-limiting column 9 is inserted into the position-limiting groove 403. In a case that the position-limiting bracket 4 rotates relative to the second bracket 103, the position-limiting column 9 slides in the arc-shaped position-limiting groove 403 for a certain distance. The distance may be designed according to the actual demand, as long as the soap bottle 7 can be taken out. The position-limiting column 9 is configured to limit an opening angle of the horizontal sliding of the position-limiting bracket 4 relative to the second bracket 103. If the opening angle is no limited, the second bracket 103 rotates freely after unlocking and the lock rod 205 is inconvenient to reset, thus affecting the user's experience.

Sixth Embodiment

Figure 9:
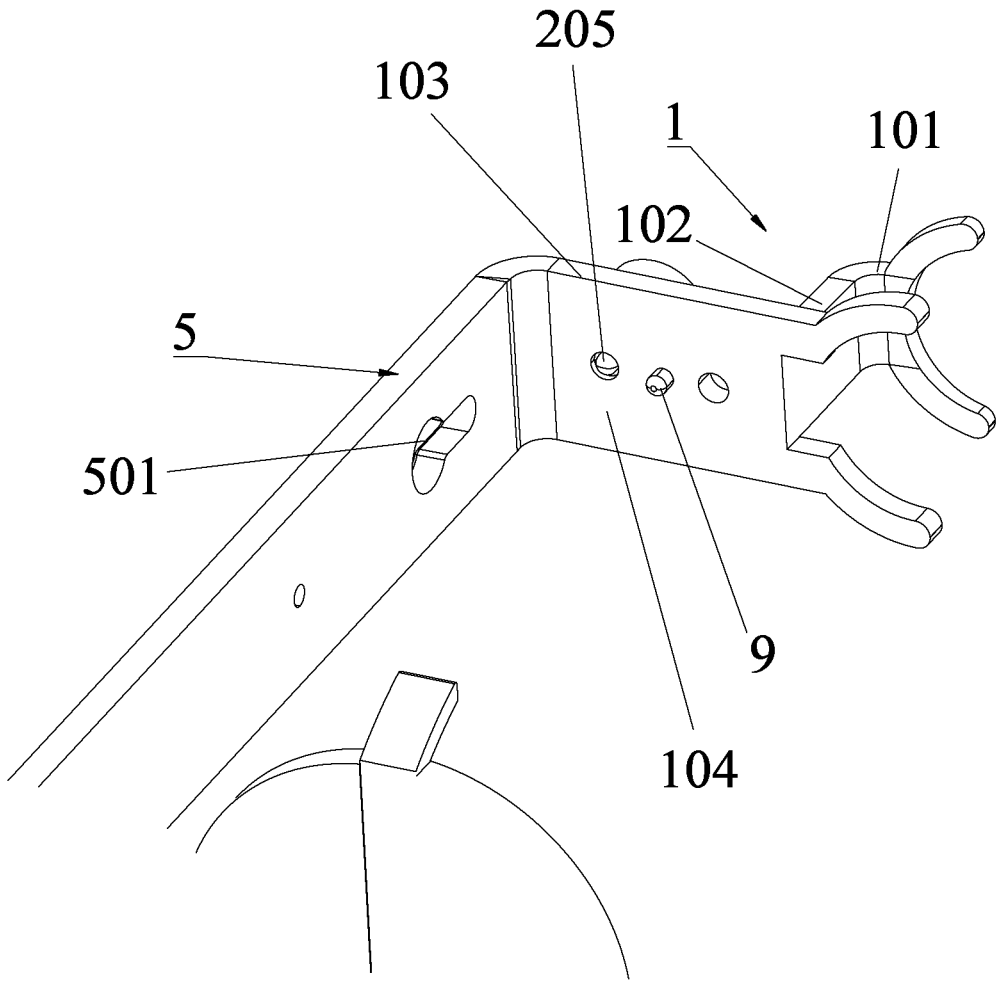
FIG. 9 is a schematic view of a fixing bracket and the pivot of the soap dispenser according to some embodiments of the present application.

As shown in FIG. 1 to FIG. 1 to FIG. 9, a soap dispenser includes all the contents of the first embodiment to the fifth embodiment. In addition, the magnetic unlocking device 8 includes an unlocking device body 800, a magnetic block 801 and a lifting ring 802. The magnetic block 801 may be placed inside the unlocking device body 800 or at an end of the unlocking device body 800, and the lifting ring 802 is arranged on the unlocking device body 800, so that the personnel can conveniently take along the magnetic unlocking device 8 and timely replace the soap bottle 7.

Seventh Embodiment

As shown in FIG. 1 to FIG. 9, a soap dispenser includes all the contents of the first embodiment to the sixth embodiment. In addition, the soap dispenser is made of pure metal material, which facilitates recycling and saves resources.

Although the present application has been described in detail above with general descriptions and specific embodiments, some modifications or improvements can be made thereto on the basis of the present application, which are obvious to those skilled in the art. Therefore, these modifications or improvements made without departing from the spirit of the present application fall within the protection scope of the present application.

Terms such as "upper", "lower", "left", "right" and "middle" used in this specification are only for explicitness of description, and are not used to limit the applicable scope of the present application. Variants in which the relative relationship is altered or adjusted without substantively changing the technical content shall still be deemed to fall in the applicable scope of the present application.

What is claimed is:

1. A soap dispenser, comprising a fixing bracket (1), a locking mechanism (2), a pivot (3), a position-limiting bracket (4), a back plate (5), a base (6), a soap bottle (7) and a magnetic unlocking device (8);

wherein the fixing bracket (1) comprises a first bracket (101), a connecting plate (102) and a second bracket (103), the first bracket (101) is connected with the second bracket (103) by the connecting plate (102), and a locking hole (104) is defined on the second bracket (103);

the locking mechanism (2) comprises a lock body (201), a lock cap (202), a spring (203), an iron block (204) and a lock rod (205); an internal hollow chamber is defined by the lock body (201) and the lock cap (202), the hollow chamber is in communication with the locking hole (104); one end of the spring (203) abuts against the top of the hollow chamber, and the other end of the spring (203) abuts against the iron block (204); the iron block (204) is movable reciprocally in the hollow chamber, the lock rod (205) is arranged on the iron block (204), and the lock rod (205) is extendable to extend through the locking hole (104);

the position-limiting bracket (4) has a front hook portion, a locking groove (401) is defined on the position-limiting bracket (4), the position-limiting bracket (4) is connected with the second bracket (103) by the pivot (3), and the bottom of the lock rod (205) is extendable into the locking groove (401);

one end of the back plate (5) is connected with the second bracket (103), the other end of the back plate (5) is connected with the base (6), and the base (6) is configured to bear the soap bottle (7); and a magnetic block (801) is provided on the magnetic unlocking device (8), the magnetic block (801) is configured to attract the iron block (204) to compress the spring (203) to approach the top of the hollow chamber, so that the bottom of the lock rod (205) is disengaged from the locking groove (401).

2. The soap dispenser according to claim 1, wherein a front end of the first bracket (101) and a front end of the second bracket (103) are arc-shaped.

3. The soap dispenser according to claim 1, wherein a pivot groove (402) is defined on the position-limiting bracket (4); one end of the pivot (3) extends through the pivot groove (402) and is rotatably connected with the position-limiting bracket (4), and the other end of the pivot (3) is rotatably connected with the second bracket (103).

4. The soap dispenser according to claim 1, wherein a mounting hole (501) is defined on the back plate (5).

5. The soap dispenser according to claim 1, wherein a plurality of holding plates (601) are provided on the base (6), and the plurality of holding plates (601) are arranged around the base (6).

6. The soap dispenser according to claim 5, wherein the plurality of holding plates (601) comprise a first holding plate (6011), a second holding plate (6012) and a third holding plate (6013), wherein the first holding plate (6011) is arranged on a side, away from the back plate (5), of the base (6), and an included angle between the second holding plate (6012) and the first holding plate (6011) and an included angle between the third holding plate (6013) and the first holding plate (6011) are right angles.

7. The soap dispenser according to claim 1, wherein a protrusion (602) is provided in the middle of the base (6).

8. The soap dispenser according to claim 1, further comprising a position-limiting column (9), wherein a position-limiting groove (403) is defined on the position-limiting bracket (4); one end of the position-limiting column (9) is fixedly connected with the second bracket (103), and the other end of the position-limiting column (9) is inserted into the position-limiting groove (403).

9. The soap dispenser according to claim 1, wherein a lifting ring (802) is provided on the magnetic unlocking device (8).

10. The soap dispenser according to claim 1, wherein the soap dispenser is made of pure metal material.

* * * * *